US008006389B2

(12) United States Patent
Jennings et al.

(10) Patent No.: US 8,006,389 B2
(45) Date of Patent: Aug. 30, 2011

(54) POCKET SAFETY CUTTER

(75) Inventors: Dale E. Jennings, Huntington Beach, CA (US); Glen Kanemoto, Costa Mesa, CA (US); Yen-Chao Chung, Taipei (TW)

(73) Assignee: Pacific Handy Cutter, Inc., Costa Mesa, CA (US)

( * ) Notice: Subject to any disclaimer, the term of this patent is extended or adjusted under 35 U.S.C. 154(b) by 561 days.

(21) Appl. No.: 11/751,400

(22) Filed: May 21, 2007

(65) Prior Publication Data

US 2008/0289190 A1 Nov. 27, 2008

(51) Int. Cl.
*B26B 1/08* (2006.01)
*B26B 1/02* (2006.01)

(52) U.S. Cl. ..... 30/162; 30/155; 30/330; 30/335

(58) Field of Classification Search ..... 30/155, 30/156, 157, 162, 329, 330, 335, 337, 339
See application file for complete search history.

(56) References Cited

U.S. PATENT DOCUMENTS 4,017,969 A * 4/1977 Stonebraker ..... 30/156
4,028,758 A 6/1977 O'Connor
4,265,017 A 5/1981 Collins
D272,513 S 2/1984 Kagebayashi
4,447,950 A 5/1984 Mizelle
4,741,106 A 5/1988 Yamagishi
4,835,865 A 6/1989 Knoop
D306,393 S 3/1990 Malochet
5,208,983 A 5/1993 Masse
5,490,331 A 2/1996 Gold
5,502,895 A 4/1996 Lemaire
D386,060 S 11/1997 O'Hara et al.
D386,061 S 11/1997 O'Hara et al.
D386,961 S 12/1997 O'Hara et al.
D389,719 S 1/1998 O'Hara et al.
5,768,787 A 6/1998 Ireland
5,769,094 A 6/1998 Jenkins, Jr. et al.
5,878,500 A 3/1999 Emerson
5,890,294 A 4/1999 Keklak et al.
6,026,575 A * 2/2000 Wonderley ..... 30/125
6,044,562 A * 4/2000 Dillenbeck ..... 30/162
6,195,896 B1 3/2001 Ireland
6,205,667 B1 3/2001 Glesser
6,354,007 B1 * 3/2002 Scarla ..... 30/156
D455,062 S 4/2002 Onion
6,438,849 B1 8/2002 Wonderly
6,453,559 B1 9/2002 Marshall et al.
6,516,520 B1 * 2/2003 Liao ..... 30/162
D471,421 S 3/2003 Lang
D474,392 S 5/2003 Lang
6,574,868 B1 6/2003 Overholt
D476,877 S 7/2003 Lang
6,637,112 B2 10/2003 Davis
6,688,003 B2 2/2004 Scarla
6,691,416 B2 2/2004 Yu Chen (Continued)

OTHER PUBLICATIONS

U.S. Appl. No. 10/966,733, (complete file history through Appeal Docketing Notice mailed on Jul. 16, 2009).

(Continued)

*Primary Examiner* — Hwei-Siu C Payer
(74) *Attorney, Agent, or Firm* — Henricks, Slavin & Holmes LLP

(57) ABSTRACT

Pocket safety cutter devices include ergonomic blade housing and handle portions adapted to be safely folded together into compact closed configurations.

11 Claims, 7 Drawing Sheets

U.S. PATENT DOCUMENTS

| | | | | |
|---|---|---|---|---|
| 6,785,966 | B2 | 9/2004 | Berns | |
| 6,829,827 | B2 * | 12/2004 | Tseng | 30/162 |
| 6,834,432 | B1 | 12/2004 | Taylor, Jr. | |
| 6,915,577 | B2 | 7/2005 | Scala | |
| 6,951,055 | B1 | 10/2005 | Collins | |
| 6,957,491 | B2 | 10/2005 | Van Deursen et al. | |
| 7,007,392 | B2 | 3/2006 | Ping | |
| 7,040,022 | B2 * | 5/2006 | Ping | 30/161 |
| 7,082,688 | B2 | 8/2006 | Votolato | |
| 7,086,157 | B2 | 8/2006 | Vallotton | |
| 7,096,586 | B2 | 8/2006 | Carpenter et al. | |
| 7,107,686 | B2 | 9/2006 | Linn et al. | |
| 7,124,458 | B2 | 10/2006 | Phelps | |
| 7,146,736 | B1 | 12/2006 | Collins | |
| 7,152,327 | B2 | 12/2006 | Rudisill et al. | |
| D539,631 | S | 4/2007 | Taylor | |
| D540,647 | S | 4/2007 | Ireland | |
| 7,296,354 | B2 | 11/2007 | Van Deursen et al. | |
| 7,380,341 | B2 * | 6/2008 | Ping | 30/161 |
| D575,613 | S * | 8/2008 | Jennings | D8/98 |
| 7,520,059 | B2 * | 4/2009 | Ranieri et al. | 30/162 |
| 7,540,092 | B2 | 6/2009 | Polei | |
| 2002/0144407 | A1 | 10/2002 | Gilbert | |
| 2002/0162229 | A1 | 11/2002 | Roberts et al. | |
| 2004/0154170 | A1 | 8/2004 | Kain et al. | |
| 2004/0250426 | A1 * | 12/2004 | Polei | 30/162 |
| 2005/0193566 | A1 | 9/2005 | Brown et al. | |
| 2005/0235499 | A1 | 10/2005 | Van Deursen et al. | |
| 2006/0080842 | A1 | 4/2006 | Schmidt | |
| 2007/0028455 | A1 | 2/2007 | Ranieri et al. | |
| 2007/0068003 | A1 | 3/2007 | Schmidt | |
| 2007/0107233 | A1 * | 5/2007 | Polei | 30/162 |
| 2007/0209209 | A1 | 9/2007 | Davis et al. | |
| 2008/0083119 | A1 * | 4/2008 | Schmidt | 30/162 |
| 2009/0193665 | A1 | 8/2009 | Ranieri et al. | |

OTHER PUBLICATIONS

U.S. Appl. No. 11/539,839, (complete file history through Information Disclosure Statement filed on Feb. 6, 2010).

U.S. Appl. No. 11/556,599, (complete file history through Non-Final Rejection mailed on Sep. 16, 2009).

PCT International Application No. PCT/US2008/064279, (complete file history through International Search Report and Written Opinion mailed on Sep. 2, 2008).

Non-final Rejection mailed on Mar. 1, 2010 through Issue Notification mailed on Jul. 28, 2010, in Schmidt, U.S. Appl. No. 11/539,839, filed Oct. 9, 2006.

Amendment/Req. Reconsideration-After Non-Final Reject filed on Mar. 16, 2010 and Final Rejection mailed on Jun. 15, 2010, in Schmidt, U.S. Appl. No. 11/556,599, filed Nov. 3, 2006.

PCT International Application No. PCT/US2007/083544, filed on Nov. 2, 2007, (complete file history through International Search Report and Written Opinion mailed on Apr. 24, 2008).

* cited by examiner

FIG. 15
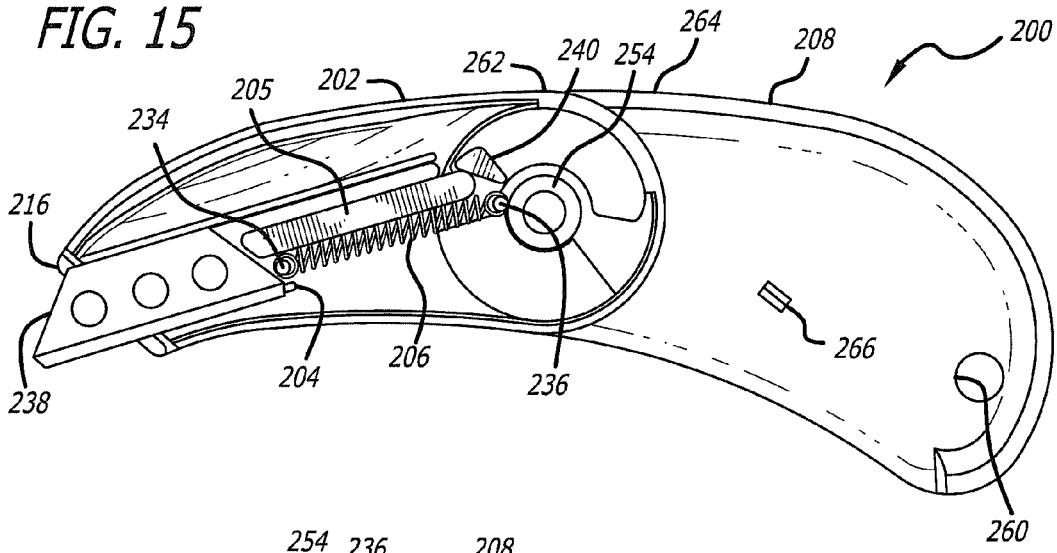
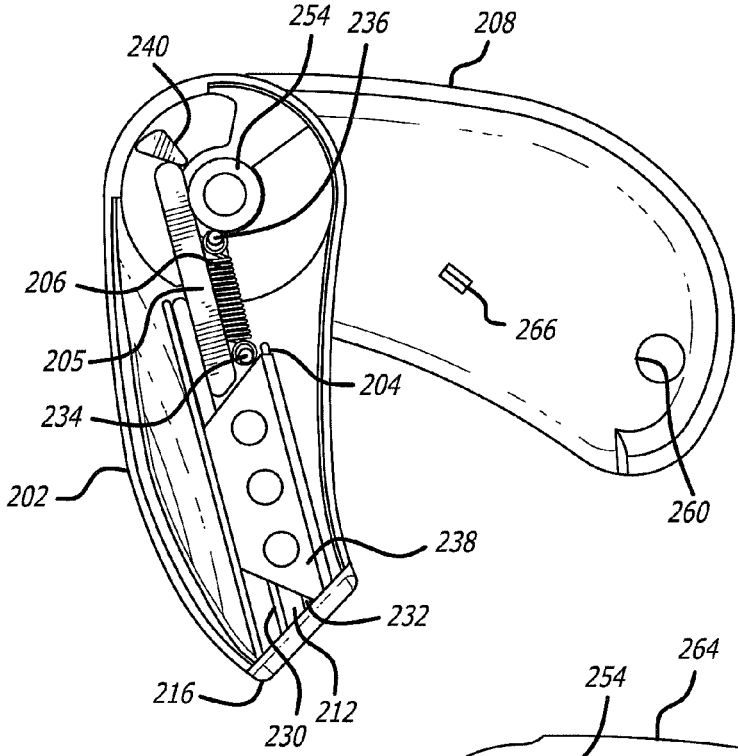
FIG. 16
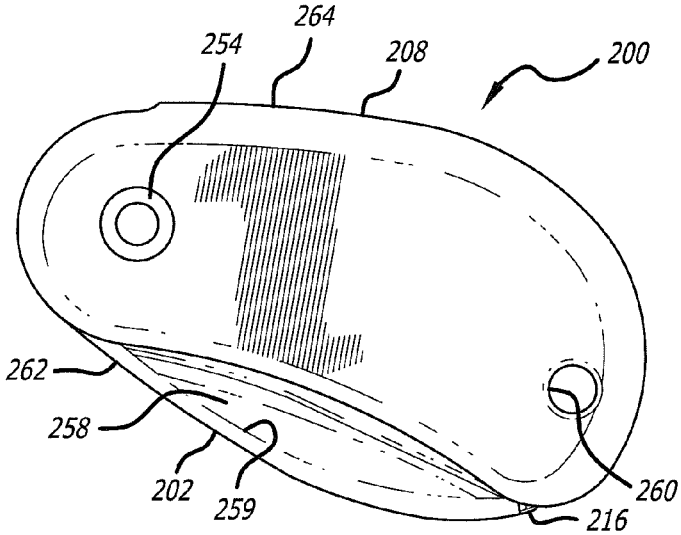
FIG. 17

POCKET SAFETY CUTTER

TECHNICAL FIELD

The present invention relates generally to knives and, in particular, pocket safety-cutter devices that can be folded into compact, closed configurations.

BACKGROUND ART

Utility knives with retractable blades are known. Knives with blades that fold into a handle are also known. However, such knives are often cumbersome or unwieldy, or suffer from deficiencies in the mechanism that is used to retract the blade. Accordingly, it would be useful to be able to provide pocket safety cutter devices that include ergonomic blade housing and handle portions that are adapted to be safely folded together into compact, closed configurations.

SUMMARY OF THE INVENTION

In an example embodiment, a pocket knife includes a housing, a blade carrier, a spring, and a handle. The housing includes an opening to a channel within the housing. The blade carrier is within the channel, and includes one or more actuator portions that permit a user of the pocket knife to slide the blade carrier along the channel. The spring is operatively connected between the blade carrier and the housing such that the blade carrier is biased along the channel toward a blade retracted position. The handle is pivotally connected to the housing, and includes a recessed portion sized to receive the housing when the housing is pivoted toward the handle.

In an example embodiment, a pocket knife includes a housing, a handle, a blade carrier, a lifter member, and a spring. The housing includes an opening to a channel within the housing. The handle is pivotally connected to the housing, and includes a recessed portion sized to receive the housing when the housing is pivoted toward the handle. The handle also includes a cam member. The blade carrier is within the channel. The lifter member is mechanically coupled to the blade carrier such that the lifter member and the cam member operatively interface to provide a cam/lifter mechanism that pushes the blade carrier toward the opening when the housing is pivoted to an open position. The spring is operatively connected between the blade carrier and the housing such that the blade carrier is biased along the channel toward a blade retracted position.

BRIEF DESCRIPTION OF THE DRAWINGS

FIG. 15 is a cross-sectional left side view of the pocket safety cutter of FIG. 10, shown in its opened position;

FIG. 16 is a cross-sectional left side view of the pocket safety cutter of FIG. 10, shown partially closed with the blade in its retracted position;

FIG. 17 is a left side view of the pocket safety cutter of FIG. 10, shown in its closed position.

DISCLOSURE OF INVENTION

Figure 1:
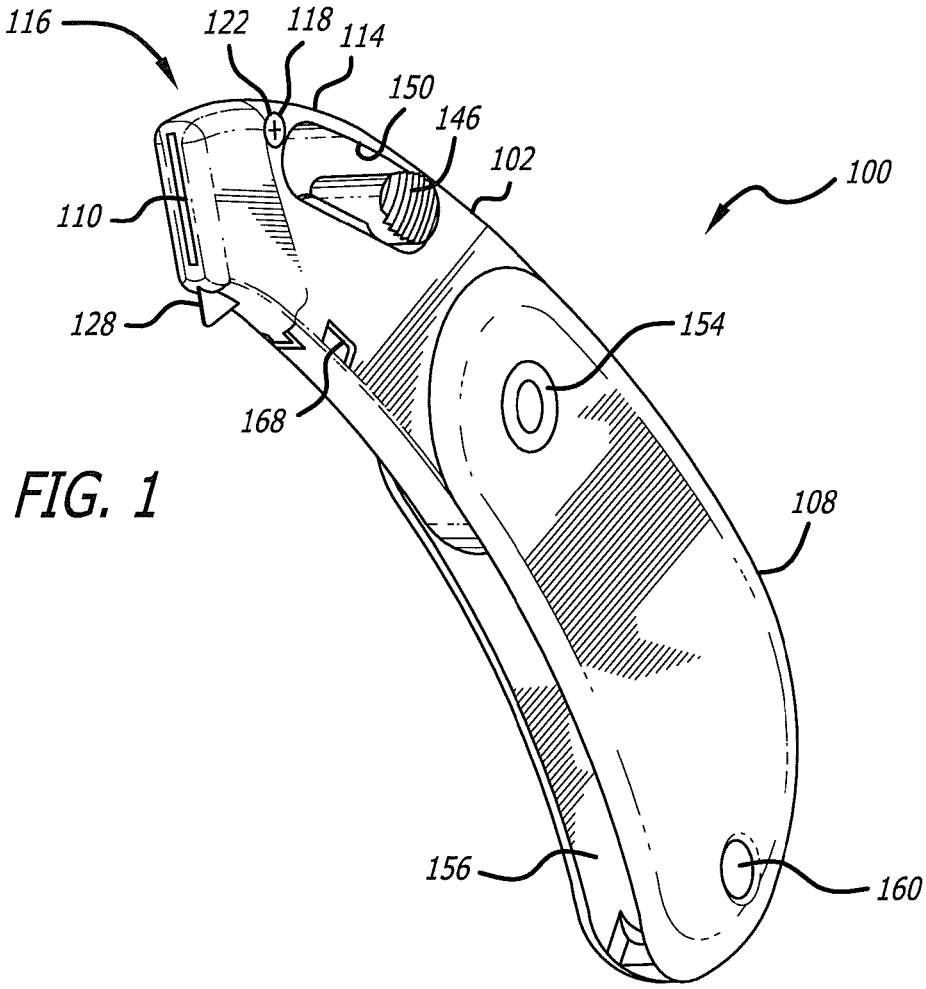
FIG. 1 is a front perspective view of an example embodiment of a pocket safety cutter.
Figure 2:
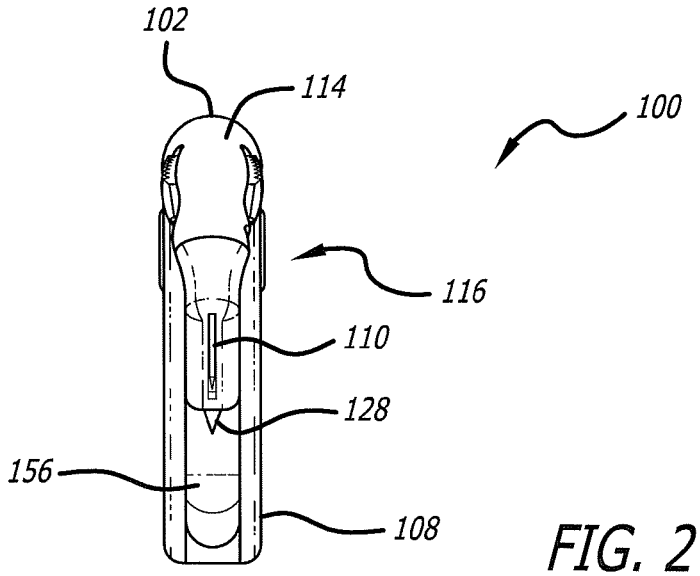
FIG. 2 is a front view of the pocket safety cutter of FIG. 1.
Figure 3:
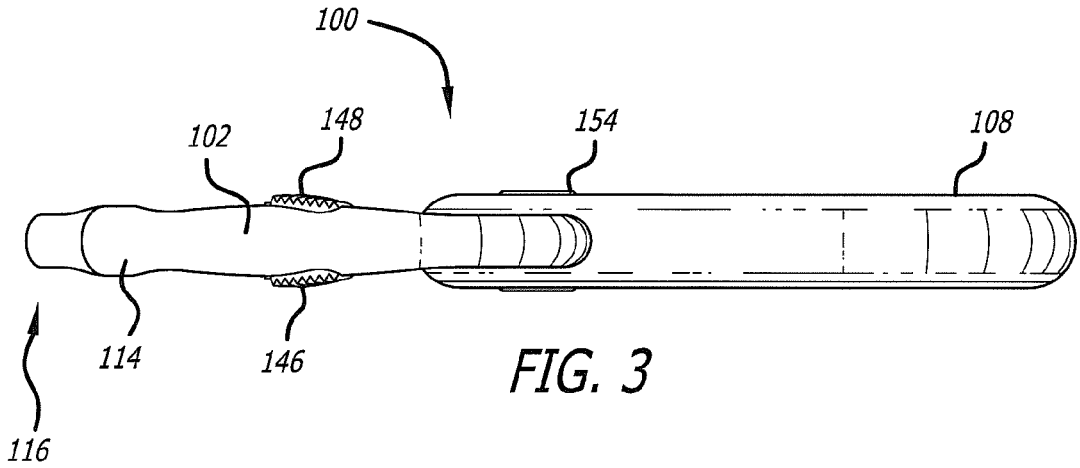
FIG. 3 is a top view of the pocket safety cutter of FIG. 1.
Figure 4:
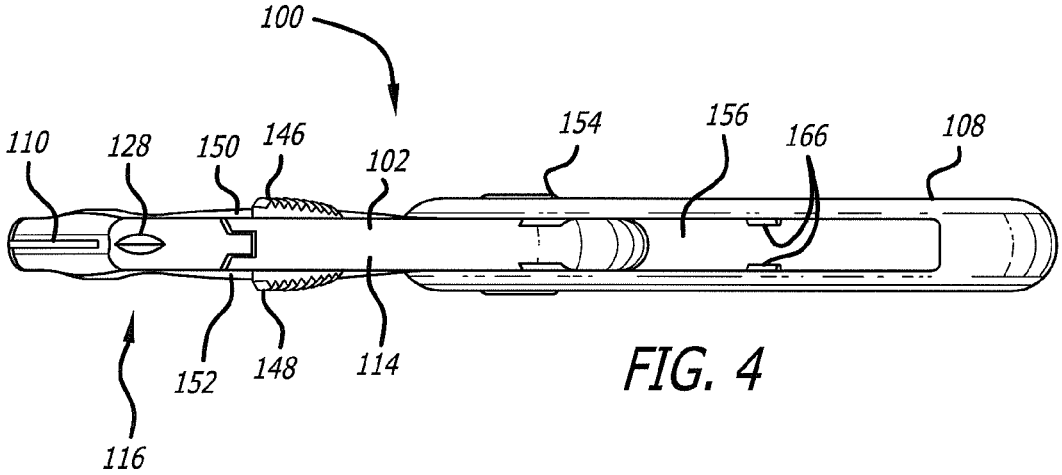
FIG. 4 is a bottom view of the pocket safety cutter of FIG. 1.

Referring to FIGS. 1-9, in an example embodiment, a pocket knife 100 includes a housing 102, a blade carrier 104, a spring 106, and a handle 108. The housing 102 includes an opening 110 to a channel 112 within the housing 102. In this example embodiment, the housing 102 includes a main portion 114 and a front end portion 116 that is pivotally secured to the main portion 114 such that the front end portion 116 can be moved to gain access to the blade carrier 104. In this example embodiment, the front end portion 116 is an assembly (e.g., a die-cast assembly) that includes a screw 118, which allows the front end portion 116 to pivot about pin 120 in relation to the main portion 114. To secure the front end portion 116 in position in relation to the main portion 114, the screw 118 is advanced through an aperture 122 (in the main portion 114), through a threaded channel 124 (of the front end portion 116), and into an indentation 126 (at an inside wall of the main portion 114).

In an example embodiment, the pocket knife 100 includes a protrusion or other tool suitable for splitting tape, or other wrappers and materials. In this example embodiment, the front end portion 116 includes a protrusion 128 adjacent to the opening 110. In this example embodiment, the protrusion 128 is fin-shaped. The positioning of the protrusion 128 on the housing 102 as shown provides an ergonomic tool for splitting tape, or other wrappers and materials.

Figure 7:
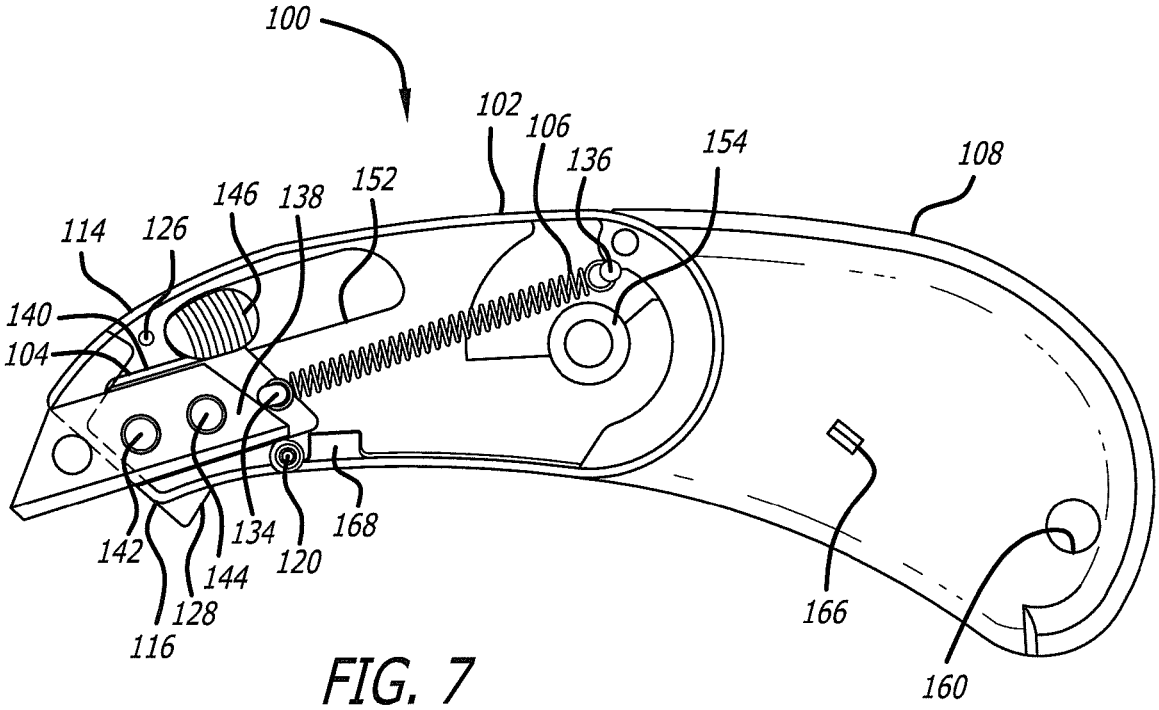
FIG. 7 is a cross-sectional left side view of the pocket safety cutter of FIG. 1, with the blade in its extended position.
Figure 8:
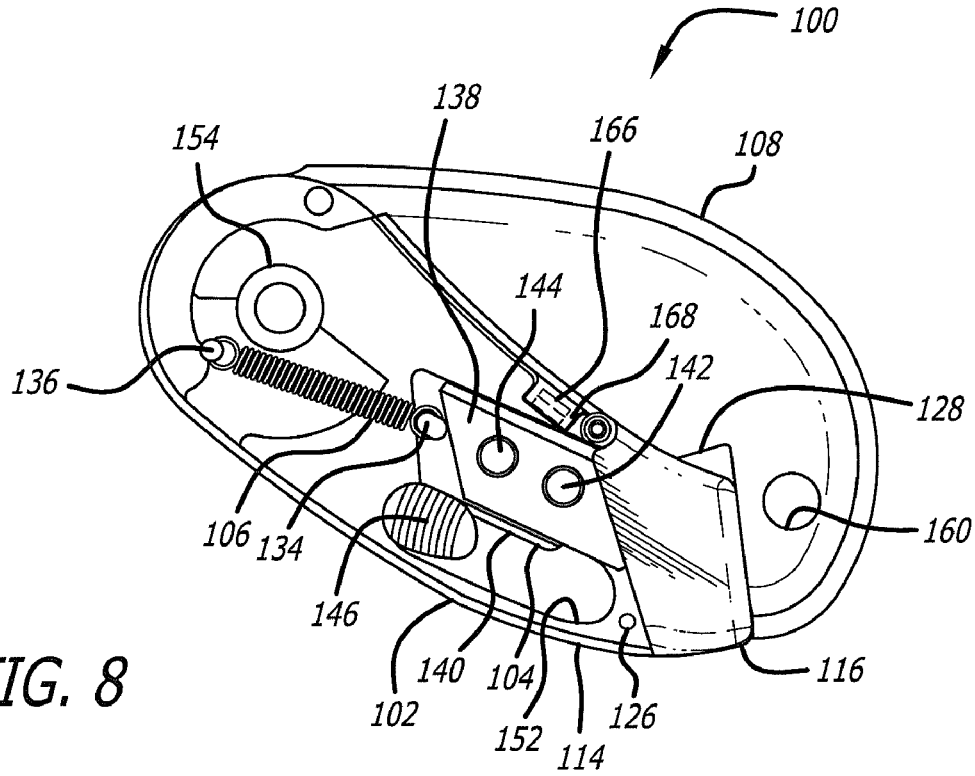
FIG. 8 is a partial cross-sectional left side view of the pocket safety cutter of FIG. 1, shown in its closed position with the housing and handle portions folded together.

The blade carrier 104 is secured within the channel 112 of the housing 102. In this example embodiment, the blade carrier 104 is supported within the channel 112 by rails 130 and 132, which are formed as shown in an inside wall of the main portion 114 of the housing 102. In an example embodiment, complementary ridges formed on the blade carrier 104 engage with the rails 130 and 132, allowing the blade carrier 104 to slide inside within the housing 102 from a blade retracted position (FIG. 6) to a blade extended position (FIG. 7). The spring 106 is operatively connected between the blade carrier 104 and the housing 102 such that the blade carrier 104 is biased along the channel 112 toward the blade retracted position. In this example embodiment, the spring 106 is connected, on opposite ends thereof, to a post 134 (on the blade carrier 104) and a post 136 (on the housing 102). A blade 138 is mechanically coupled to the blade carrier 104. In this example embodiment, the blade carrier 104 includes a rail 140 and securing posts 142 and 144, which prevent lateral movement of the blade 138 when the blade is positioned adjacent to the blade carrier 104 as shown.

The blade carrier 104 includes one or more actuator portions that permit a user of the pocket knife 100 to slide the blade carrier 104 along the channel 112. In this example embodiment, the one or more actuator portions include two actuator portions 146 and 148.

In an example embodiment, the housing 102 includes one or more slots through which the one or more actuator portions extend. In this example embodiment, the one or more slots include two slots 150 and 152 located on opposite sides of the housing 102.

Figure 9:
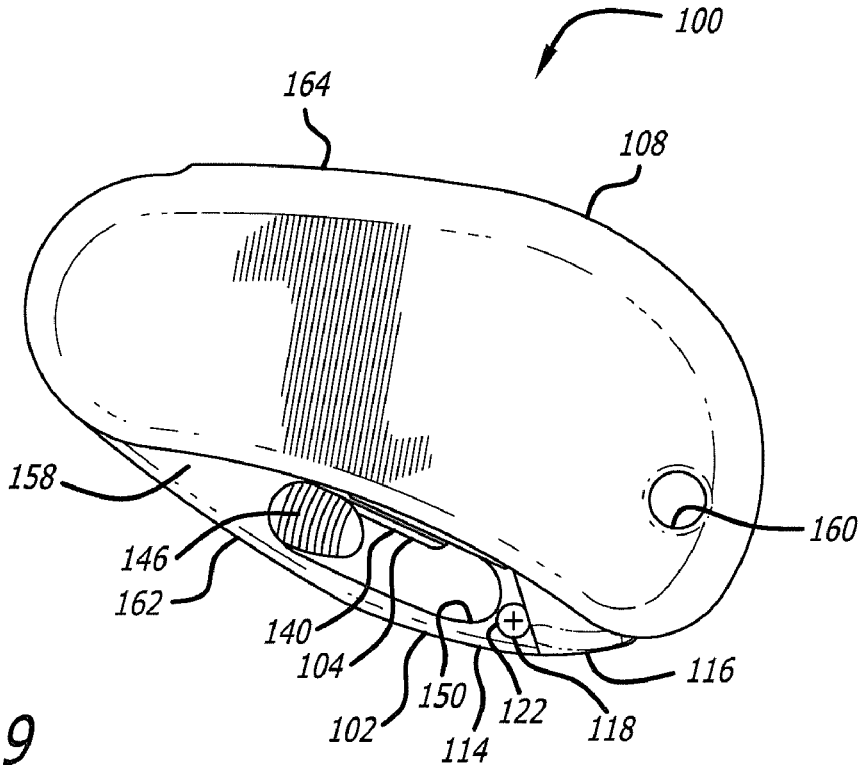
FIG. 9 is a left side view of the pocket safety cutter of FIG. 1, shown in its closed position.
Figure 10:
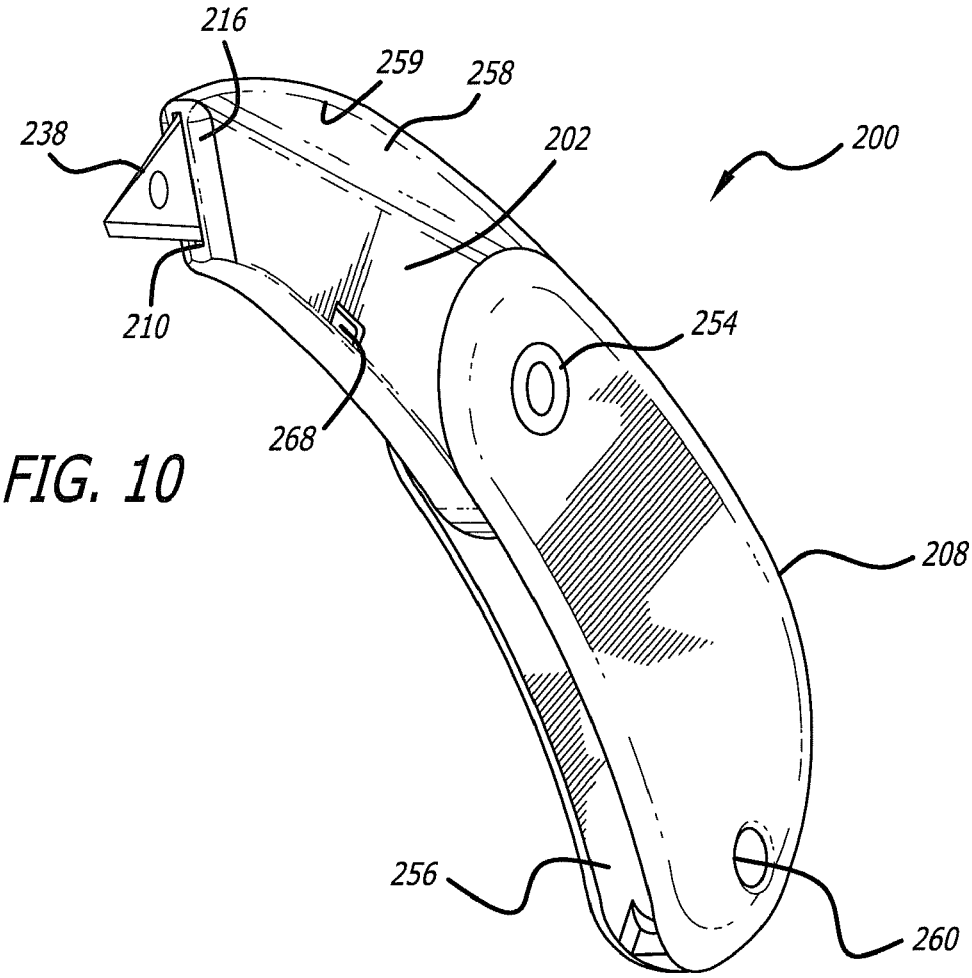
FIG. 10 is a front perspective view of another example embodiment of a pocket safety cutter.
Figure 11:
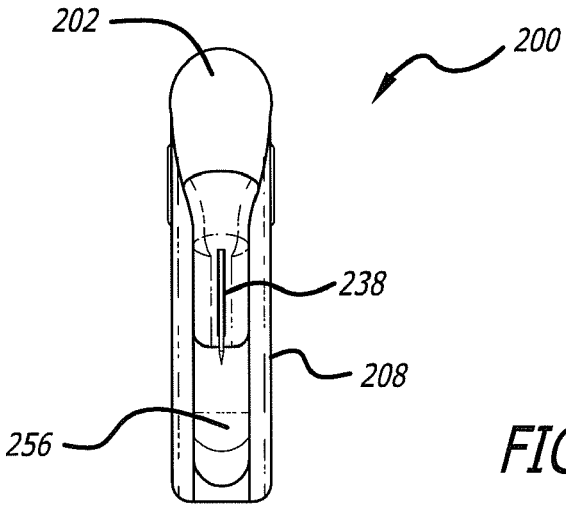
FIG. 11 is a front view of the pocket safety cutter of FIG. 10.
Figure 12:
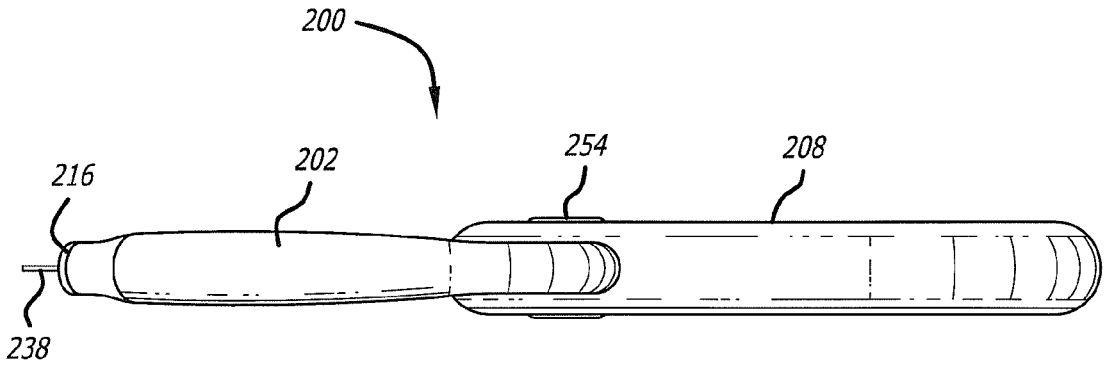
FIG. 12 is a top view of the pocket safety cutter of FIG. 10.
Figure 13:
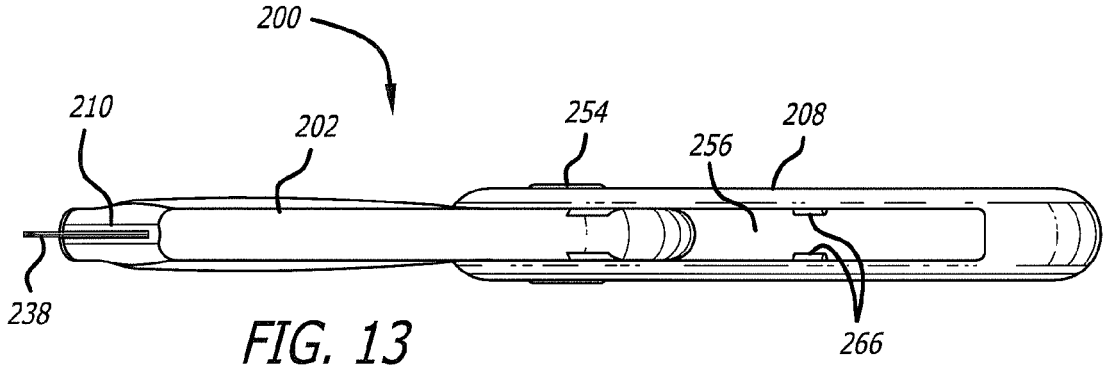
FIG. 13 is a bottom view of the pocket safety cutter of FIG. 10.
Figure 14:
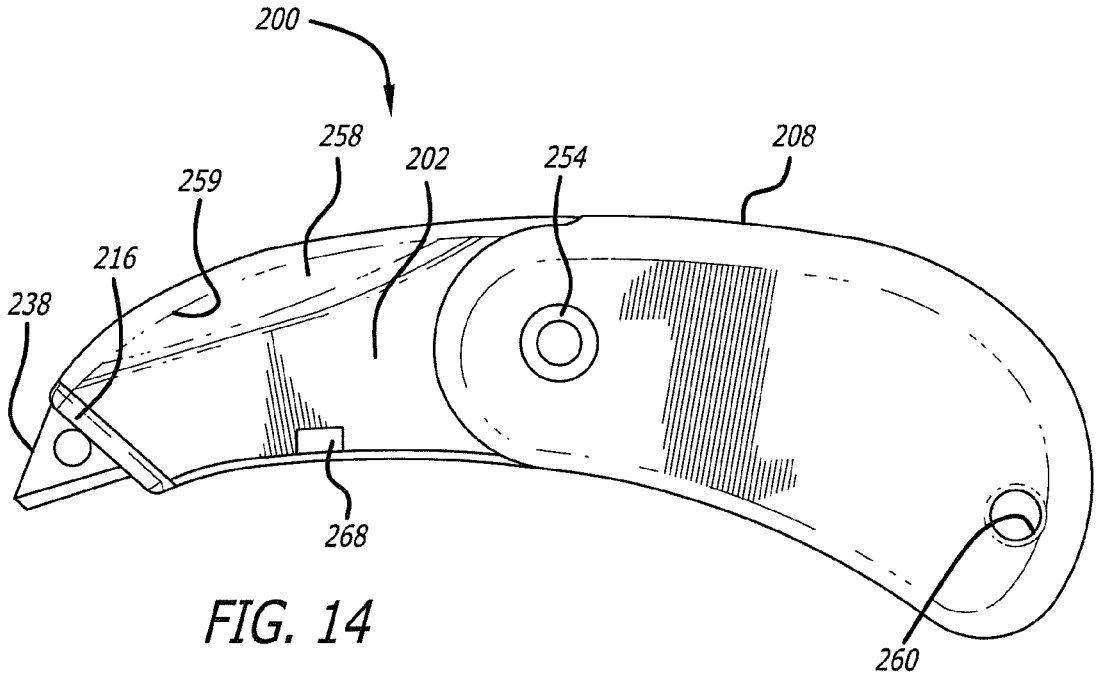
FIG. 14 is a left side view of the pocket safety cutter of FIG. 10.

In this example embodiment, the handle 108 is pivotally connected to the housing 102 about a bearing 154, and the handle 108 includes a recessed portion 156 sized to receive the housing 102 when the housing 102 is pivoted toward the handle 108. In this example embodiment, the housing 102 is shaped such that a portion 158 of the housing 102 that includes the one or more slots extends from the recessed portion 156 when the housing 102 is pivoted into the handle 108 to a closed position (FIG. 9). In this example embodiment, the handle 108 also includes an aperture 160 (e.g., at its base) through which a cord, string, lanyard, or the like can be attached to the pocket knife 100.

Figure 5:
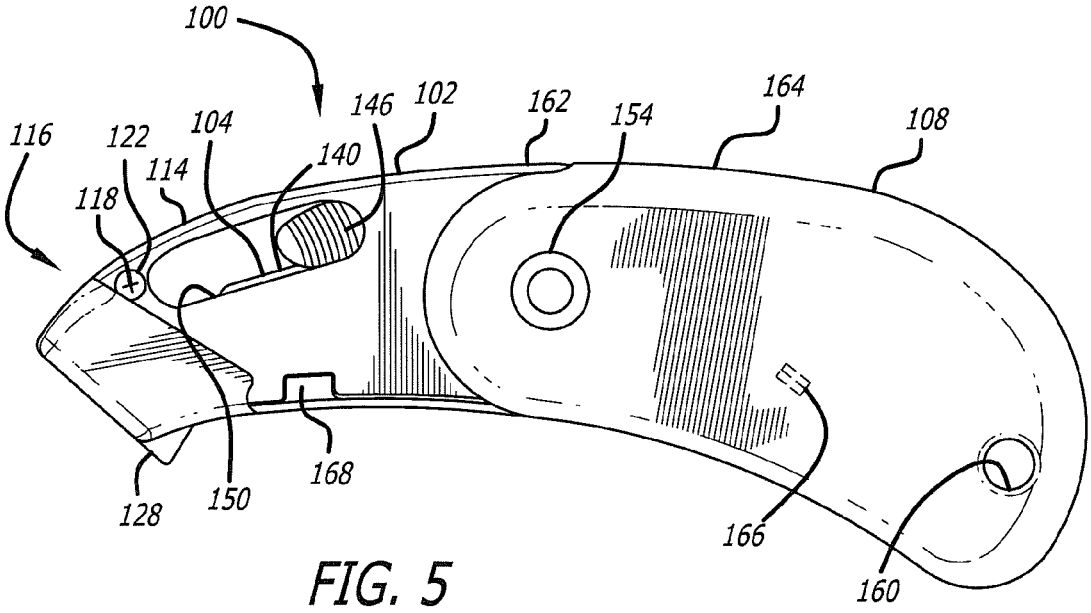
FIG. 5 is a left side view of the pocket safety cutter of FIG. 1.
Figure 6:
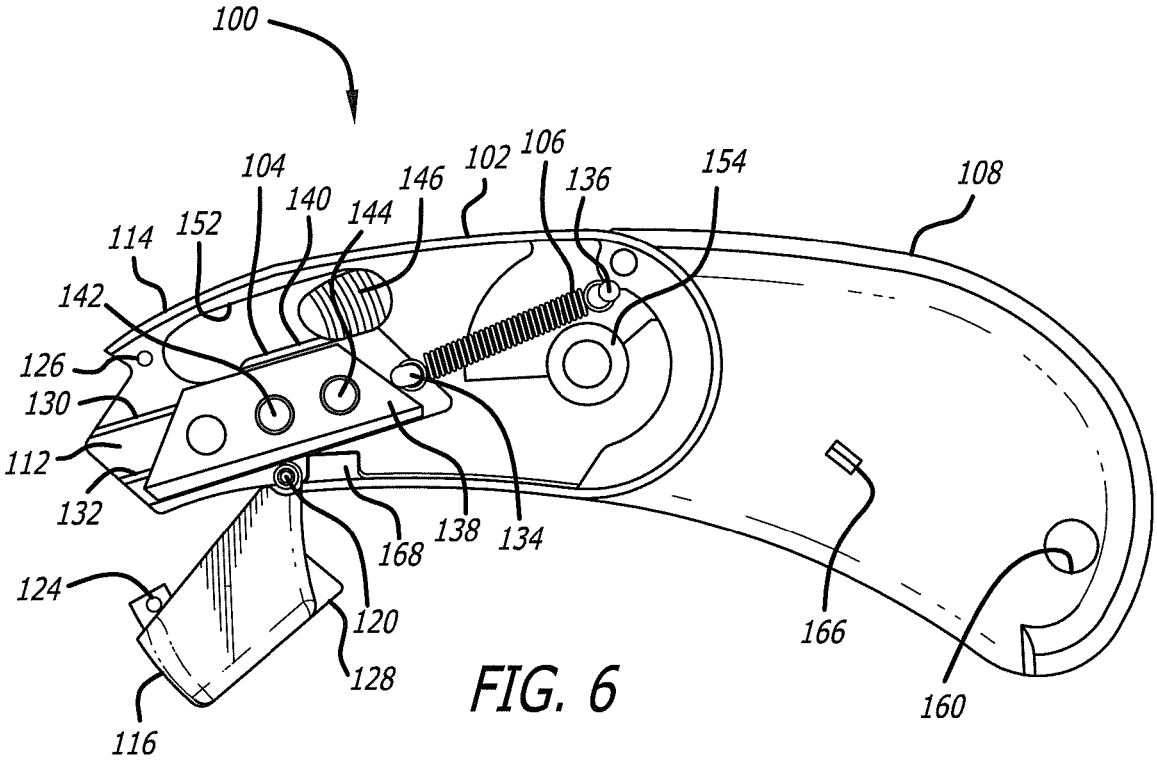
FIG. 6 is a partial cross-sectional left side view of the pocket safety cutter of FIG. 1, with the front end portion of the housing pivoted open and the blade in its retracted position.

In this example embodiment, the housing 102 and handle 108 each include complementary exterior surfaces 162 and 164, respectively, that define a curved top edge of the pocket knife 100 when the housing 102 is pivoted out of the handle 108 to an opened position (as shown in FIG. 5). Also, in this example embodiment, the complementary exterior surfaces 162 and 164 provide the pocket knife 100 with a profile shape that is substantially symmetrical when the housing 102 is pivoted into the handle 108 to a closed position (as shown in FIG. 9). In this example embodiment, tabs 166 formed on the inside of the handle 108 are snap-fitted into indented portions 168 of the housing 102 when the housing 102 is pivoted into the handle 108 to the closed position.

In operation, a user of the pocket knife 100 can use the two slots 150 and 152 to grasp and pivot the housing 102 out of the recessed portion 156. The blade 138, biased by the spring 106, remains in its blade retracted position until the blade carrier 104 is slid, by contact with one or more of the actuator portions 146 and 148, to the blade extended position. When the actuator portions 146 and 148 are released, the spring 106 immediately pulls the blade carrier 104 back to the blade retracted position.

Referring to FIGS. 10-17, in an example embodiment, a pocket knife 200 includes a housing 202, a blade carrier 204, a lifter member 205, a spring 206, and a handle 208. The housing 202 includes an opening 210 to a channel 212 within the housing 202. In this example embodiment, the housing 202 includes a front portion 216 (e.g., a die-cast piece), which defines the opening 210 at least in part.

The blade carrier 204 (similar to the blade carrier 104) is secured within the channel 212 of the housing 202. In this example embodiment, the blade carrier 204 is supported within the channel 212 by rails 230 and 232, which are formed as shown in an inside wall of the housing 202. In an example embodiment, complementary ridges formed on the blade carrier 204 engage with the rails 230 and 232, allowing the blade carrier 204 to slide inside within the housing 202 from a blade retracted position (FIG. 16) to a blade extended position (FIG. 15). The spring 206 is operatively connected between the blade carrier 204 and the housing 202 such that the blade carrier 204 is biased along the channel 212 toward the blade retracted position. In this example embodiment, the spring 206 is connected, on opposite ends thereof, to a post 234 (on the blade carrier 204) and a post 236 (on the housing 102). A blade 238 is mechanically coupled to the blade carrier 204 (e.g., as described above with reference to the blade 138 and the blade carrier 104).

In this example embodiment, the handle includes a cam member 240 shaped as shown. The lifter member 205 is mechanically coupled to the blade carrier 204 such that the lifter member 205 and the cam member 240 operatively interface to provide a cam/lifter mechanism that pushes the blade carrier 204 toward the opening 210 when the housing 202 is pivoted to an open position (as shown in FIG. 15). In an example embodiment, the cam member 240 is fixed in position in relation to the handle 208. In an example embodiment, the spring 206 is adjacent and/or parallel to the lifter member 205.

In this example embodiment, there are no actuators that permit a user to slide the blade carrier 204; rather the lifter member 205 and the cam member 240 (i.e., cam/lifter mechanism) and the spring 206 automatically reposition the blade carrier 204 depending upon the position of the housing 202 in relation to the handle 208.

In this example embodiment, the handle 208 is pivotally connected to the housing 202 about a bearing 254, and the handle 208 includes a recessed portion 256 sized to receive the housing 202 when the housing 202 is pivoted toward the handle 208. In this example embodiment, the housing 202 is shaped such that a portion 258 of the housing 202 that includes a ridge 259 extends from the recessed portion 256 when the housing 202 is pivoted into the handle 208 to a closed position (FIG. 17). In this example embodiment, the handle 208 also includes an aperture 260 (e.g., at its base) through which a cord, string, lanyard, or the like can be attached to the pocket knife 200.

In this example embodiment, the housing 202 and handle 208 each include complementary exterior surfaces 262 and 264, respectively, that define a curved top edge of the pocket knife 200 when the housing 202 is pivoted out of the handle 208 to an opened position (as shown in FIG. 15). Also, in this example embodiment, the complementary exterior surfaces 262 and 264 provide the pocket knife 200 with a profile shape that is substantially symmetrical when the housing 202 is pivoted into the handle 208 to a closed position (as shown in FIG. 17). In this example embodiment, tabs 266 formed on the inside of the handle 208 are snap-fitted into indented portions 268 of the housing 202 when the housing 202 is pivoted into the handle 208 to the closed position.

In operation, a user of the pocket knife 200 can use the ridge 259 to grasp and pivot the housing 202 out of the recessed portion 256. The blade 238, biased by the spring 206, remains in its blade retracted position until the blade carrier 204 is repositioned to the blade extended position, by action of the lifter member 205 making contact with and being pushed by the cam member 240. In other words, the cam/lifter mechanism pushes the blade carrier 204 toward the opening 210 when the housing 202 is pivoted to its open position, where the post 236 is now positioned slightly "above center" with respect to the bearing 254 (as shown in FIG. 15). When the user folds the housing 202 back toward the handle 208, i.e., toward the closed position, the spring 206 provides an assisting force that biases the housing 202 toward its closed position.

Although the present invention has been described in terms of the example embodiments above, numerous modifications and/or additions to the above-described embodiments would be readily apparent to one skilled in the art. It is intended that the scope of the present invention extend to all such modifications and/or additions.

What is claimed is:

1. A pocket knife comprising:

a housing including an opening to a channel within the housing;

a blade carrier within the channel, the blade carrier including one or more actuator portions that permit a user of the pocket knife to slide the blade carrier along the channel;

a spring operatively connected between the blade carrier and the housing such that the blade carrier is biased along the channel toward a blade retracted position; and a handle pivotally connected to the housing, the handle including a recessed portion sized to receive the housing when the housing is pivoted toward the handle;

wherein the housing includes a main portion and a front end portion that is pivotally secured to the main portion such that the front end portion can be moved to gain access to the blade carrier.

2. The pocket knife of claim 1, further comprising:

a blade mechanically coupled to the blade carrier.

3. The pocket knife of claim 1, wherein the housing includes a front end portion that includes a protrusion adjacent to the opening, the protrusion being received within the recessed portion when the housing is pivoted into the handle to a pocket knife closed position.

4. The pocket knife of claim 3, wherein the protrusion is fin-shaped.

5. The pocket knife of claim 1, wherein the housing includes one or more slots through which the one or more actuator portions extend.

6. The pocket knife of claim 5, wherein the one or more slots include two slots located on opposite sides of the housing.

7. The pocket knife of claim 5, wherein the housing is shaped such that a portion of the housing that includes the one or more slots extends from the recessed portion when the housing is pivoted into the handle to a closed position.

8. The pocket knife of claim 1, wherein the front end portion is a die-cast assembly that includes a screw.

9. The pocket knife of claim 1, wherein the one or more actuator portions include two actuator portions.

10. The pocket knife of claim 1, wherein the housing and the handle each include complementary exterior surfaces that provide the pocket knife with a profile shape that is substantially symmetrical when the housing is pivoted into the handle to a closed position.

11. The pocket knife of claim 1, wherein the housing and the handle each include complementary exterior surfaces that define a curved top edge of the pocket knife when the housing is pivoted out of the handle to an opened position.

* * * * *